US006928942B2

(12) United States Patent
Aschenbach

(10) Patent No.: US 6,928,942 B2
(45) Date of Patent: Aug. 16, 2005

(54) DOWNCOMER FOR MARINE VESSELS

(76) Inventor: Karl L. Aschenbach, 7140 55$^{th}$ Ave. South, Seattle, WA (US) 98118

( * ) Notice: Subject to any disclaimer, the term of this patent is extended or adjusted under 35 U.S.C. 154(b) by 0 days.

(21) Appl. No.: 10/693,422

(22) Filed: Oct. 24, 2003

(65) Prior Publication Data

US 2004/0112272 A1 Jun. 17, 2004

(51) Int. Cl.$^{7}$ ..... B63B 21/14
(52) U.S. Cl. ..... 114/179; 114/182
(58) Field of Search ..... 114/182, 183 R, 114/179

(56) References Cited

U.S. PATENT DOCUMENTS 5,868,514 A * 2/1999 Gibson ..... 403/3
2004/0103948 A1 * 6/2004 Scheelen et al. ..... 138/141

OTHER PUBLICATIONS

"Fluid Transport Equipment," *Encyclopedia of Fluid Mechanics*, Vol. 2, Dynamics of Single–Fluid Flows and Mixing, pp. 1194, 1197, and 1200–1203.

"Reactors and Industrial Applications," *Encyclopedia of Fluid Mechanics*, vol. 3, Gas–Liquid Flows; pp. 1478, 1482, and 1487.

Simon X. Xu, Lowell Pless; "Distillation tower flooding—more complex than you think: while other "predictive" methods tell too little, too late, gamma scans indicate where and why flooding occurs—invaluable insight for trouble-shooters," from *Chemical Engineering*, Jun. 1, 2002, ISSN: 0009–2460; vol. 109; Issue6; pp.: 8full text.

Michael W. Biddulph, Christopher P. Thomas, Alan C. Burton, "Don't Downplay Downcomer Design," from *Chemical Engineering Progress*, Dec. 1993, pp. 56–60.

* cited by examiner

*Primary Examiner*—Stephen Avila
(74) *Attorney, Agent, or Firm*—Stoel Rives LLP

(57) ABSTRACT

A downcomer for conveying wastewater from an upper level of a marine vessel to a lower level of the marine vessel includes a pair of spaced apart mounting portions and an elongate impact portion extending between the mounting portions. Each mounting portion is adapted for attachment to the marine vessel, and the shape of the elongate impact portion defines a concave space through which the wastewater is conveyed. In one preferred embodiment, a synthetic elastomeric tube, hose, or liner is placed within the concave space, and the wastewater is conveyed from the upper level of the marine vessel to the waterline through the tube, hose, or liner. In another preferred embodiment, the mounting portions and the elongate impact portion are extruded to form a unitary structure including a lightweight, rust-resistant ultrahigh molecular weight polyethylene.

12 Claims, 5 Drawing Sheets

DOWNCOMER FOR MARINE VESSELS

TECHNICAL FIELD

The present invention relates to a downcomer for use in conveying wastewater from an upper level of a marine vessel to a lower level of the marine vessel and, in particular, to a lightweight, rust-resistant downcomer formed of an ultrahigh molecular weight polyolefin.

BACKGROUND OF THE INVENTION

Downcomers are commonly used to convey a substance, typically wastewater, from an upper level of a marine vessel to a lower level of the marine vessel along the outside of the vessel's hull. The wastewater is preferably conveyed from either the interior of the marine vessel or its deck to the waterline. "Wastewater" refers to both gray water (water from sink and shower drains) and black water (water from toilet drains). FIGS. 1A and 1B show various prior art downcomers 2 extending along a hull 4 of a marine vessel 6 toward a waterline 8 where the wastewater conveyed by downcomer 2 is discharged. A top 10 of downcomer 2 may extend toward waterline 8 from any level of marine vessel 6. For example, top 10 of downcomer 2 may extend from a deck 14 while a bottom 12 of downcomer 2 may be located close to waterline 8. Such a downcomer may be fed by a deck-mounted scupper or scupper drain extending from deck 14. Alternatively, top 10 of downcomer 2 may be positioned at any location along hull 4 and may extend to any location on hull 4 below top 10 of downcomer 2. The only constraint on where the upper and lower levels are positioned is that the lower level must be physically situated below the upper level. As shown in FIG. 1, the upper level of downcomer 2 may be deck 14 or any location along the vertical axis of hull 4, and the lower level of downcomer 2 may be the waterline or any location along the vertical axis of hull 4. Downcomer 2 may include cap section 16 that extends from hull 4 at an angle. Cap section 16 preferably includes vents 18 that prevent pressure buildup or vacuum formation in downcomer 2. Downcomers attach to the side of marine vessel 6 via fasteners 20 that are spaced along the length of downcomer 2. Typically, of downcomers have a half-pipe shape and are stud-welded to hull 4 of marine vessel 6.

Because of its position on marine vessel 6, downcomer 2 is subject to multiple high-force impacts during harsh docking conditions and collisions with tugboats. When the force of these impacts exceeds the yield strength of downcomer 2, it dents, leaving a permanent deformation. Such deformation must be repaired to maintain a smooth surface and so that wastewater may be efficiently conveyed into the water. Guards 22 are sometimes mounted along the flanks of downcomer 2 to absorb a portion of impacts. Also, guards 22 may protect downcomer 2 from being ripped off of hull 4 during docking of marine vessel 6. However, guards 22 add cost and may not be effective when impact with tugboats or docks occurs above or below guards 22.

Known downcomers are made of steel, presumably due to its high yield strength. However, even steel downcomers can be dented during impact. Repair of a steel downcomer requires that the dented downcomer be removed from the hull and a new undented downcomer be attached in its place. Alternatively, the dented portion of the downcomer can be removed and an undented portion can be rewelded in its place. Both approaches are expensive and time-consuming. Further, downcomers repaired using the second method often experience leaking or an increased incidence of rust or corrosion at the weld.

The outer surface of the downcomer is typically painted so that the downcomer color matches the color of the marine vessel and to delay rust formation. However, maintenance of the painted and/or coated steel downcomers includes regular repainting and general upkeep to prevent rust and corrosion. This regular maintenance is both expensive and time-consuming.

The present inventor has recognized a need for a downcomer that can absorb a substantial amount of energy upon impact without permanently deforming, that is highly resistant to rust and corrosion, that is easily installed and repaired, that is lightweight and hydrodynamic at the water line, and that requires little or no maintenance.

SUMMARY OF THE INVENTION

A downcomer for conveying wastewater from an upper level of a marine vessel to a lower level of the marine vessel includes a pair of spaced-apart mounting portions and an elongate impact portion extending between the mounting portions. Each mounting portion is adapted for attachment to the hull of the marine vessel, and the elongate impact portion has a shape that defines a concave space through which the wastewater is conveyed. The mounting portions and the elongate impact portion are preferably integrally formed in a unitary structure by extrusion of a lightweight, rust-resistant ultrahigh molecular weight polyethylene material having a high impact resistance.

In one embodiment, a synthetic elastomeric, high temperature, chemically resistant tube is placed within the concave space, and the wastewater is conveyed from an upper level of the marine vessel toward the waterline through the tube. In another embodiment, the downcomer has a hydrodynamic, wing-shaped profile resulting from the elongate impact portion extending outwardly from the mounting portions. In another embodiment the outer edge of the downcomer is attached to the outside of the marine vessel's hull by steel keys or tabs to prevent spreading of the legs of the downcomer profile. The use of these steel keys or tabs makes the downcomer significantly stronger than the prior art steel downcomers.

Additional aspects and advantages of the invention will be apparent from the following detailed description of preferred embodiments, which proceeds with reference to the accompanying drawings.

DETAILED DESCRIPTION OF THE PREFERRED EMBODIMENTS

Figure 2:
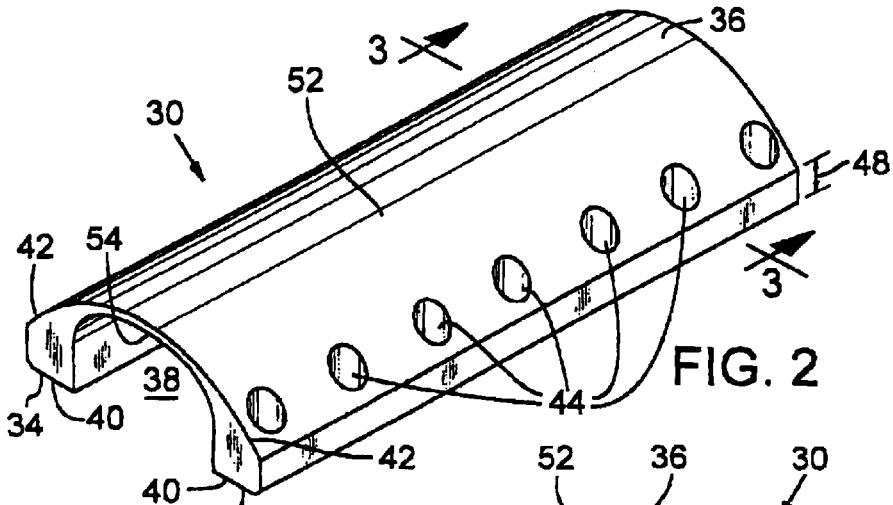
FIG. 2 is an isometric view of a downcomer in accordance with the first embodiment.
Figure 3:
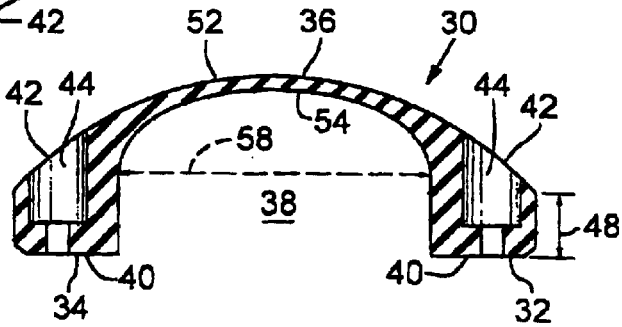
FIG. 3 is a cross-sectional view of the downcomer of FIG. 2, taken along line 3—3 of FIG. 2.
Figure 4:
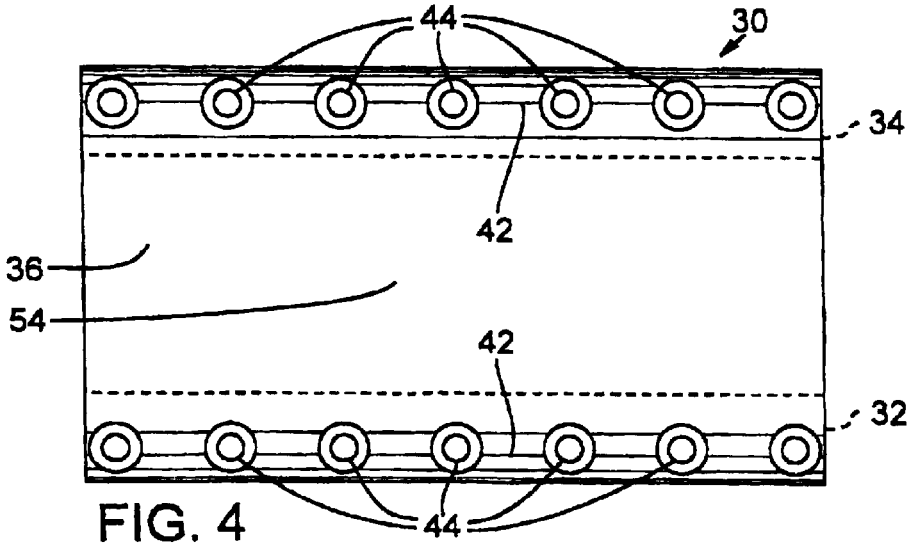
FIG. 4 is a top view of the downcomer of FIG. 2.

FIG. 2 is an isometric view of a downcomer 30 in accordance with a first embodiment. FIGS. 3 and 4 are cross-sectional and top views, respectively, of downcomer 30 of FIG. 2. With reference to FIGS. 2–4, downcomer 30 includes a pair of spaced-apart mounting portions 32 and 34 and an elongate impact portion 36 extending between mounting portions 32 and 34. Mounting portions 32 and 34 are adapted for attachment to hull 4 (FIG. 5) of marine vessel 16, and the shape of elongate impact portion 36 defines a concave space 38 through which the wastewater is conveyed. In a preferred embodiment, mounting portions 32 and 34 and elongate impact portion 36 are integrally formed of a unitary, one-piece construction.

Each of mounting portions 32 and 34 includes a rear side 40 that faces toward hull 4, and a front side 42 opposite rear side 40 that faces away from hull 4. Each of mounting portions 32 and 34 preferably includes multiple mounting holes 44 extending through a thickness 48 of mounting portions 32 and 34 and spaced along the length of downcomer 30. Each mounting hole 44 is sized to receive a mounting fastener 46 (shown in FIG. 5) for attaching downcomer 30 to hull 4 of marine vessel 6. Each mounting hole 44 preferably includes a countersink or a counterbore that has sufficient depth so that a head or nut of mounting fastener 46 does not protrude above front side 42, thereby preventing damage to mounting fastener 46 and rear side 40 of mounting portions 32 and 34.

Thickness 48 of mounting portions 32 and 34 will typically be dictated by the size of mounting fastener 46, the thickness of elongate impact portion 36, and the amount of material necessary to securely fasten downcomer 30 to hull 4. However, other considerations such as flexibility, expected loads, durability, and aesthetics may also be considered when determining thickness 48 of mounting portions 32 and 34. Thickness 48 may also vary in differing individual sections 72 of downcomer 30. For example, thickness 48 of the downcomer sections 72 closest to waterline 8 may be thicker than downcomer sections 72 closest to hull 4 because downcomer sections 72 closest to waterline 8 must withstand greater impact strength because the incidence of impact with tugboats or docks is significantly greater at waterline 8. For example, thickness 48 may be in the range of about 1 inch (254 cm) to about 5 inches (12.7 cm) depending on the size of marine vessel 6. At about 1 inch (2.54 cm) thickness, mounting portions 32 and 34 will preferably have a height of about 2.75 inches (5.29 cm). Each of mounting portions 32 and 34 may optionally be backed by a layer of elastomeric material 50 (FIG. 5) interposed between rear side 40 of mounting portions 32 and 34 and hull 4 of marine vessel 6, to provide dampening and load distribution. Mounting portions 32 and 34 are preferably formed of a flexible yet resilient material, such as an ultrahigh molecular weight polyethylene (UHMWPE).

Mounting fastener 46 (FIG. 5) attaches downcomer 30 to hull 4 by coupling mounting portions 32 and 34 and hull 4. Exemplary mounting fasteners 46 include bolts, studs, screws, or rivets, but other fasteners may be used. Where mounting fastener 46 is a bolt, the head or nut of the bolt can be below the surface of downcomer 20. In another preferred embodiment mounting fastener 46 is a steel key or tab whose use prevents spreading of mounting portions 32 and 34. The use of these steel keys or tabs makes downcomer 30 significantly stronger than prior art steel downcomers.

Elongate impact portion 36 is bounded by an outer surface 52 and a concave inner surface 54. Thus the shape of elongate impact portion 56 defines concave space 38 between hull 4 and elongate impact portion 36 when downcomer 30 is mounted to hull 4. A preferred elongate impact portion 36 has a U-shaped cross-section. Elongate impact portion 36 absorbs a portion of the energy transferred to downcomer 30 during an impact. The amount of energy absorbed by downcomer 30 will be a function of the shape and thickness of elongate impact portion 36, the structural dimensions of which are selected based on expected impact forces. For example, elongate impact portion 36 may have a thickness 56 (shown in FIG. 5) ranging between about 1 inch (2.54 cm) and about 5 inches (12.7 cm), dependent on the size of marine vessel 6. A diameter 58 (FIG. 3) of concave space 38 may range between about 5 inches (12.7 cm) and about 12 inches (30.5 cm), dependent on the size of marine vessel 6. A preferred thickness 56 of elongate impact portion 36 is about 2.5 inches (6.4 cm), and the preferred diameter 58 of concave space 38 is about 8 inches (20.3 cm) for average-sized ocean-going vessels.

Mounting portions 32 and 34 and elongate impact portion 36 of downcomer 30 are preferably made of UHMWPE. However, mounting portions 32 and 34 may be formed of an alternative material. A preferred UHMWPE has a low coefficient of sliding friction, high abrasion resistance, and high strength characteristics, particularly modulus of elasticity (Young's modulus), yield strength, and impact strength. An exemplary preferred UHMWPE is a crystalline UHMWPE. A preferred commercially available UHMWPE conforms to ASTM 4020. Favorable physical properties of UHMWPE include a modulus of elasticity (Young's modulus) at room temperature of between about 0.6 GPa and about 0.8 GPa (ASTM D638 and D6712), a tensile yield strength ranging between about 21.0 MPa and about 22.3 MPa, an ultimate tensile strength ranging between about 46.8 MPa and about 53.7 MPa, and an Izod impact strength of between about 70 $kJ/m^2$ and about 220 $kJ/m^2$ (modified ASTM D256, double 15° V-notched; ASTM D6712, depending on the material composition and the fabrication method used). UHMWPE is also highly abrasion-resistant, hydrophobic, and chemically resistant. Also, UHMWPE can be successfully used in temperatures ranging from 200° F. to −160° F. It accepts additives, such as UV stabilizers and fire retardants that are included in the preferred embodiments of downcomer 30. Mixing a pigment with UHMWPE eliminates the need to paint downcomer 30 and permits either matching the color of downcomer 30 to the color of hull 4, or having downcomer 30 and hull 4 have high-contrast colors. Both options result in long-lasting visibility without the expense of painting and repainting downcomer 30. UHMWPE can also be machined using conventional woodworking equipment, for example, drilling mounting holes 44 after the body of downcomer 30 is formed.

Additionally, UHMWPE surfaces can be textured, treated, coated, or imparted with fillers to impart radar-scattering or absorbing properties desirable when downcomer 30 is used in military applications requiring stealth capabilities. For example, the ultrablack surface topology described in U.S. Pat. No. 5,225,933 of Myers et al. could be formed on or applied to an outer surface of downcomer 30. Skilled persons will appreciate that different surface textures that are suitable for manufacture by extrusion may also be used. Although other materials can be used in the manufacture of downcomer 30, UHMWPE has a combination of physical properties, including abrasion resistance, strength, low friction, moldability, and resistance to permanent deformation, that makes it especially desirable.

Although any of a variety of fabrication techniques can be used in the manufacture of downcomer 30, extrusion and hot bending are preferred fabrication techniques. Further, two or more materials can be co-extruded to achieve different mechanical properties at different sections of downcomer 30 while maintaining its integral structure.

Figure 5:
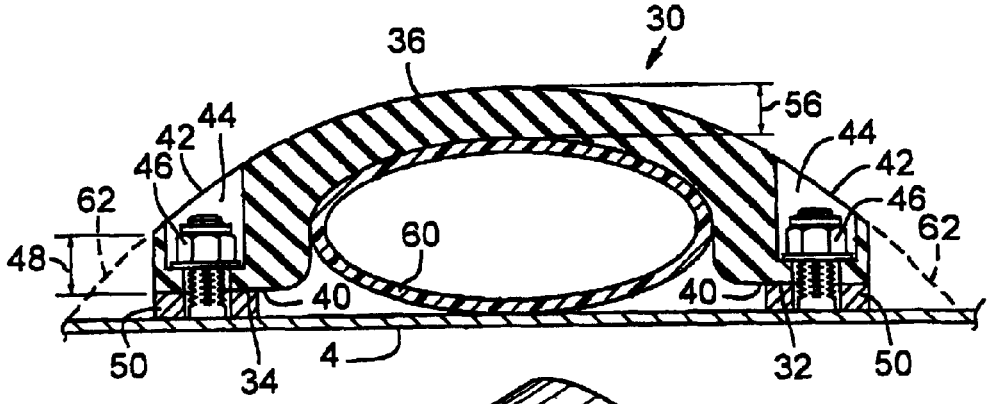
FIG. 5 is a cross-sectional view of the downcomer of FIG. 2, taken along line 3—3 of FIG. 3, attached to the hull of a marine vessel and further including a synthetic rubber liner.

FIG. 5 is a cross-sectional view of downcomer 30 of FIG. 2, taken along line 3—3 of FIG. 2. Downcomer 30 is attached to hull 4 of marine vessel 6 and includes a liner 60 positioned within concave space 38 through which wastewater is conveyed. In a preferred embodiment, liner 60 is a hose or a tube formed of synthetic elastomer and positioned within concave space 38. Liner 60 is positioned adjacent inner surface 54 of elongate impact portion 36 and hull 4 of marine vessel 6. Liner 60 typically extends from a scupper or scupper drain toward bottom 12 of downcomer 30. Further, liner 60 may, but need not, extend the entire length of downcomer 30 to bottom 12. Liner 60 is preferably made of a synthetic elastomer such as neoprene or another corrosion-resistant, chemical-resistant, temperature-resistant, resilient material. Liner 60 preferably extends from a scupper or scupper drain near top 10 of downcomer 30 to bottom 12 of downcomer 30.

As mentioned above, elastomeric material 50 can be interposed between downcomer 30 and hull 4 of marine vessel 6. A preferred elastomer material 50 is UV-stabilized outdoor marine-grade rubber having a hardness of approximately 65 durometer. Elastomeric material 50 is preferably in the form of a washer or strip, as shown in FIG. 5.

Figure 6:
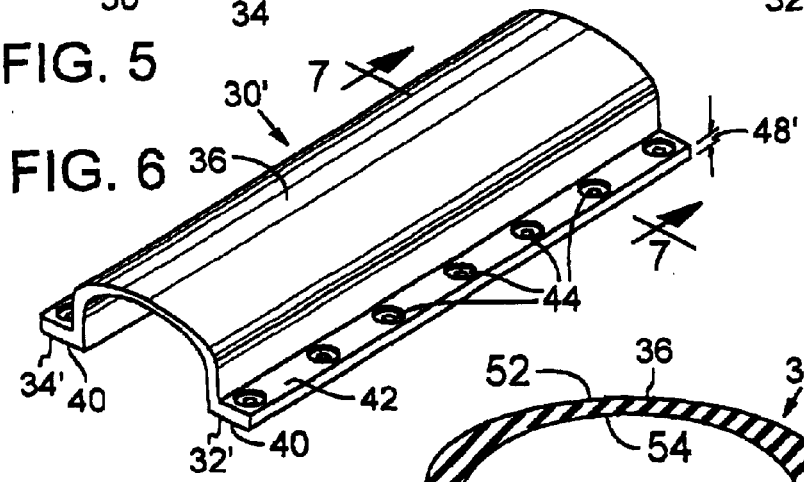
FIG. 6 is an isometric view of a downcomer in accordance with a second embodiment of the present invention.
Figure 7:
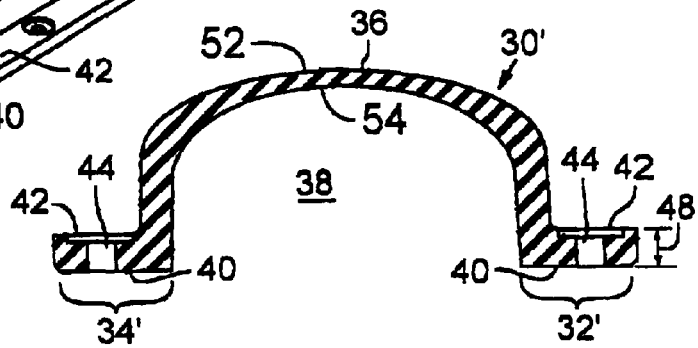
FIG. 7 is a cross-sectional view of the downcomer of FIG. 6, taken along line 7—7 of FIG. 6.
Figure 8:
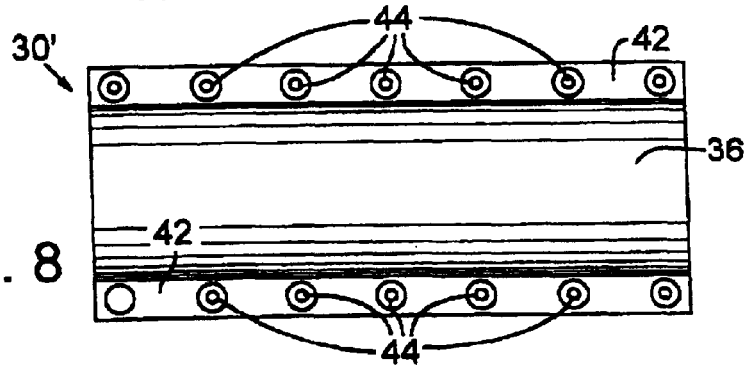
FIG. 8 is a top view of the downcomer of FIG. 6.

FIG. 6 is an isometric view of a downcomer 30' in accordance with a second preferred embodiment of the present invention. FIGS. 7 and 8 are cross-sectional (taken along line 7—7) and top views, respectively, of downcomer 30' of FIG. 6. With reference to FIGS. 6–8, downcomer 30' is similar to downcomer 30 (shown in FIGS. 2–5) except that the shape of mounting portions 32' and 34' differs from the shape of mounting portions 32 and 34.

Figure 9:
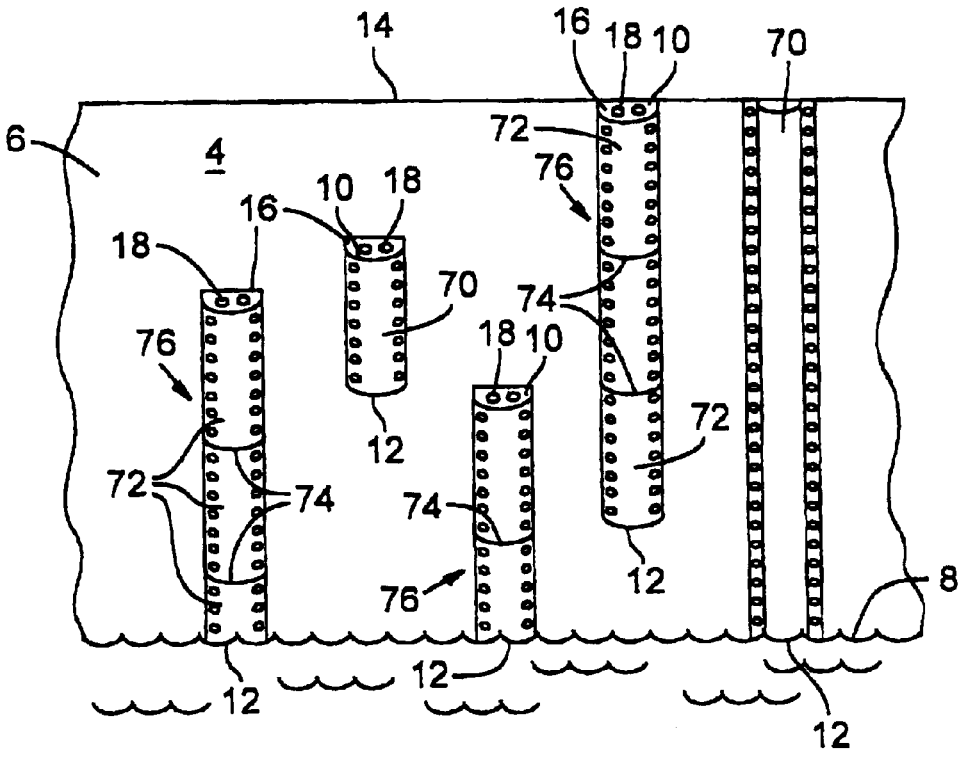
FIG. 9 is a schematic drawing of a hull of a marine vessel having attached to it various single unit downcomers and downcomer assemblies including multiple individual downcomer sections.

As shown in FIG. 9, downcomer 30 of the present invention may be a single unit downcomer 70 that extends from an upper level (e.g., deck 14) of marine vessel 6 to a lower level (e.g., waterline 8) of marine vessel 6. Alternatively, downcomer 30 may consist of multiple individual downcomer sections 72 having opposed ends 74 that are aligned to form a downcomer assembly 76.

Figure 1A:
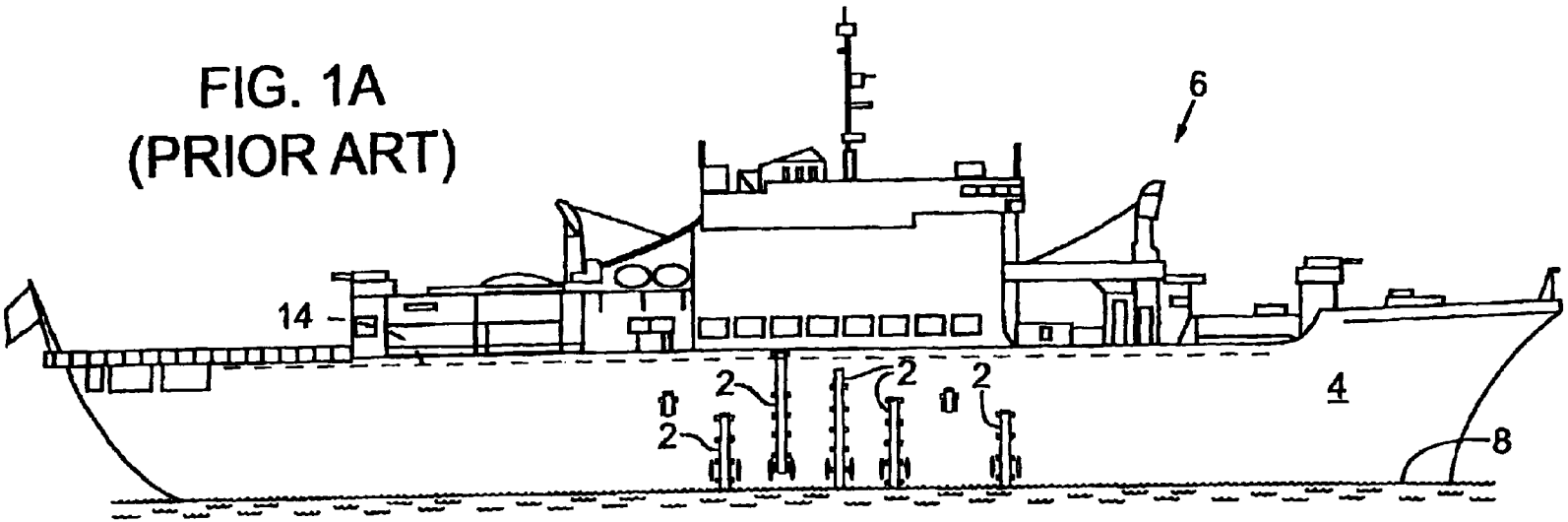
FIG. 1A (PRIOR ART)
FIGS. 1A and 1B are side elevation views of a marine vessel to which is mounted multiple prior art steel downcomers.
Figure 1B:
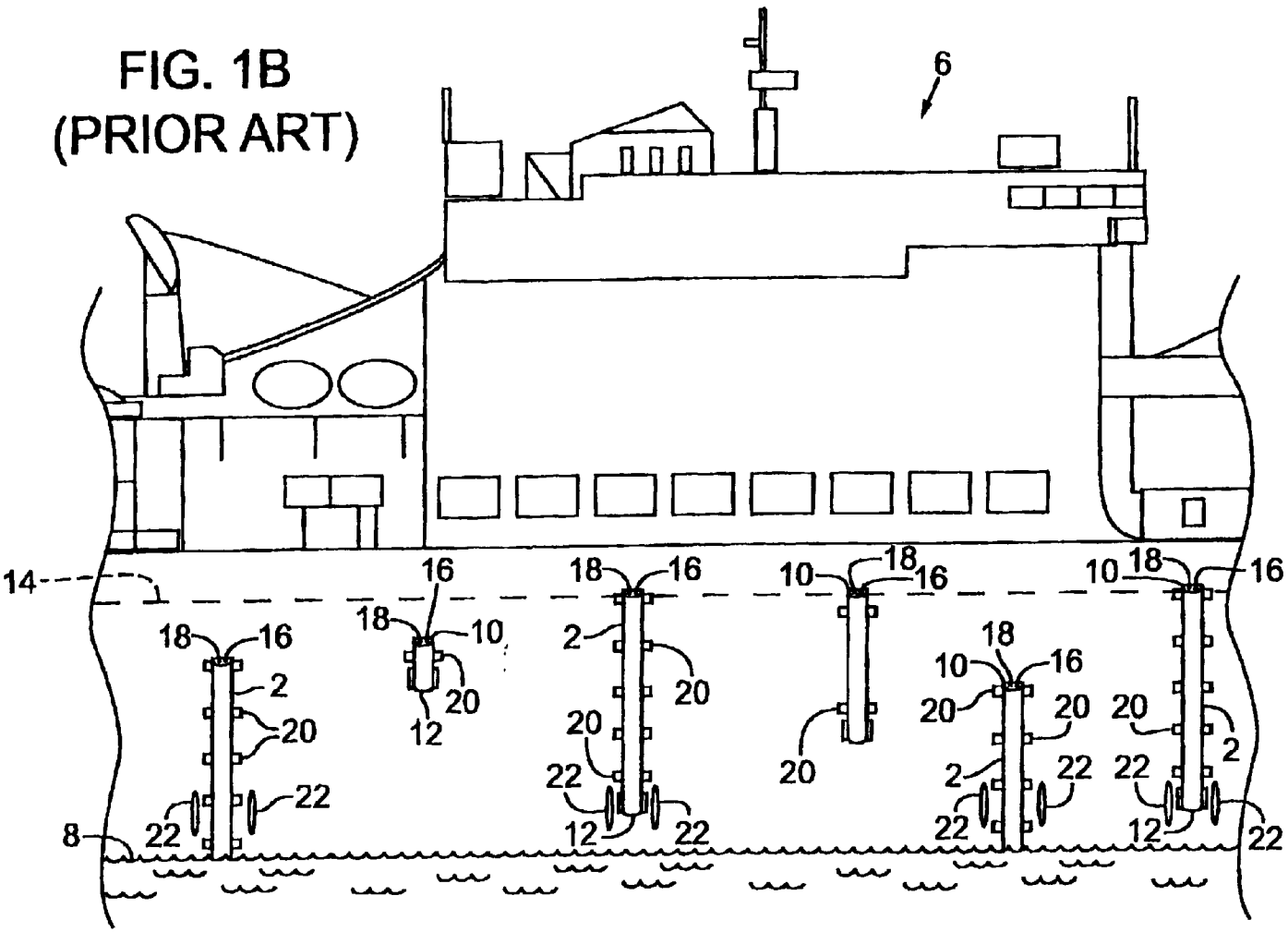
FIG. 1B (PRIOR ART)

As shown in FIGS. 1 and 9, top 10 of downcomer 2 may be positioned at any location along hull 4 and may extend to any location along hull 4 below the upper level. More specifically, the upper level is the location on hull 4 at which top 10 of downcomer 2 is positioned, and the lower level is the location on hull 4 at which bottom 12 of downcomer 2 is positioned. The only constraint on where the upper and lower levels are positioned is that the lower level must be physically situated below the upper level. As shown in FIG. 1, the upper level of downcomer 2 may be deck 14 or any location along the vertical axis of hull 4, and the lower level of downcomer 2 may be the waterline or any location along the vertical axis of hull 4.

The unique shape and design of the downcomers in accordance with the preferred embodiment, offer numerous advantages over prior art downcomers. In one embodiment, elongate impact portion extends outwardly from mounting portions 32 and 34 a distance of less than diameter 58, and preferably less than half of diameter 58 resulting in a the hydrodynamic wing-shaped profile of downcomer 30. As shown in dashed lines 62 in FIG. 5, hydrodynamic drag of downcomer 30 can be further reduced by extending outer surface 52 of elongate impact portion 36 to meet hull 4 at an acute angle.

Further, the use of UHMWPE facilitates the addition of UV resistant pigments throughout downcomer 30, thus eliminating the time-consuming and expensive need for maintenance in the form of painting and repainting, while simultaneously providing colorfastness throughout the thickness of downcomer 30. Additionally, UHMWPE weighs significantly less than the steel used in prior art downcomers, thereby facilitating installation, maintenance, and repair. Further, downcomer 30 of the present invention does not rust and is generally resistant to the corrosive effects of the wastewater it conveys to the waterline. The use of a UHMWPE material also provides increased resistance to denting and/or puncture of downcomer 30 during impact. Further, any damage to downcomer 30 can be easily and inexpensively repaired by removing the damaged portion and replacing it with a new portion. Finally, the wing-shaped profile of downcomer 30 of the present invention offers improved hydrodynamic qualities that result in better flow at the waterline and more even distribution of the wastewater exiting the downcomer at the waterline. It is anticipated that the thick lower downcomer sections may replace the "elephant ears" that are welded to the hull to protect the steel downcomer from impact with tugs and docks.

It will be obvious to those having skill in the art that many changes may be made to the details of the above-described embodiments without departing from the underlying principles of the invention. The scope of the present invention should, therefore, be determined only by the following claims.

What is claimed is:

1. A lightweight, rust-resistant downcomer for use in conveying a substance from an upper level of a marine vessel to a lower level of the marine vessel, comprising:

a pair of spaced apart mounting portions adapted for attachment to a side of the marine vessel; and an elongate impact portion extending between the spaced apart mounting portions and bordering a concave space through which the substance is conveyed, the elongate impact portion made of an ultrahigh molecular weight polyethylene.

2. The downcomer of claim 1, further comprising a liner lining the concave space.

3. The downcomer of claim 2, in which the liner includes a synthetic elastomeric tube.

4. The downcomer of claim 1, in which the mounting portions include a mounting hole for receiving a mounting fastener for attaching the downcomer to the side of the marine vessel.

5. The downcomer of claim 4, in which the mounting fastener is selected from the group consisting essentially of bolts, studs, screws, and rivets.

6. The downcomer of claim 1, further including a pigment.

7. The downcomer of claim 1, further including an ultraviolet stabilizer.

8. The downcomer of claim 1, in which the mounting portions and the elongate impact portion form an integral structure made of an ultrahigh molecular weight polyethylene.

9. The downcomer of claim 8, in which the integral structure is formed by a method selected from a group consisting essentially of extrusion, co-extrusion, and hot bending.

10. The downcomer of claim 1, in which the elongate impact portion has a generally U-shaped cross-section.

11. A downcomer assembly including multiple downcomers in accordance with claim 1, aligned end-to-end.

12. A downcomer, comprising:

a structure made of an ultrahigh molecular weight polyolefin and a first mounting portion and a second mounting portion spaced apart and adapted for attachment.

* * * * *

UNITED STATES PATENT AND TRADEMARK OFFICE

CERTIFICATE OF CORRECTION

PATENT NO. : 6,928,942 B2
APPLICATION NO. : 10/693422
DATED : August 16, 2005
INVENTOR(S) : Karl L. Aschenbach It is certified that error appears in the above-identified patent and that said Letters Patent is hereby corrected as shown below:

Col. 6, replace claim 12 with the following:

12. A downcomer, comprising:

a structure made of an ultrahigh molecular weight polyolefin and a first mounting portion and a second mounting portion spaced apart and adapted for attachment to a side wall of a marine vessel, and an elongate impact portion bounded by an outer surface and a concave inner surface and extending between the spaced apart mounting portions; and further comprising a synthetic elastomeric tube comprised of neoprene and positioned within a space bordered by the concave inner surface such that the tube is adjacent to the concave inner surface and to the side wall of the marine vessel when the downcomer is mounted to the marine vessel.

Signed and Sealed this

Seventh Day of August, 2007

JON W. DUDAS
*Director of the United States Patent and Trademark Office*